US010121459B2

(12) United States Patent
Steinhauser

(10) Patent No.: US 10,121,459 B2
(45) Date of Patent: Nov. 6, 2018

(54) MUSICAL INSTRUMENT CASE

(71) Applicant: GEWA music GmbH, Adorf/Vogtland (DE)

(72) Inventor: Ruben Steinhauser, Altusried (DE)

(73) Assignee: GEWA music GmbH, Adorf/Vogtland (DE)

( * ) Notice: Subject to any disclaimer, the term of this patent is extended or adjusted under 35 U.S.C. 154(b) by 22 days.

(21) Appl. No.: 15/177,393

(22) Filed: Jun. 9, 2016

(65) Prior Publication Data

US 2017/0206870 A1 Jul. 20, 2017

(30) Foreign Application Priority Data

Jan. 20, 2016 (DE) ..... 10 2016 100 954

(51) Int. Cl.

| | |
|---|---|
| ***A45C 11/00*** | (2006.01) |
| ***G10G 5/00*** | (2006.01) |
| ***B65D 25/10*** | (2006.01) |
| ***G10G 7/00*** | (2006.01) |

(52) U.S. Cl.

CPC ..... *G10G 5/00* (2013.01); *B65D 25/102* (2013.01); *G10G 7/005* (2013.01)

(58) Field of Classification Search

CPC .. B65D 25/101; B65D 25/102; B65D 25/103; G10G 5/00; G10G 7/005; A45C 11/00

USPC ..... 206/14, 314; 190/18 R; 211/85.6; 150/162

See application file for complete search history.

(56) References Cited

U.S. PATENT DOCUMENTS

| | | | | |
|---|---|---|---|---|
| 3,326,359 | A * | 6/1967 | Katz | G10G 7/005 206/14 |
| 5,875,890 | A * | 3/1999 | Di Bernardini | G10D 9/06 190/125 |
| 6,283,287 | B1 | 9/2001 | Carl | |
| 7,687,701 | B1 * | 3/2010 | Kushner | G10G 7/005 206/314 |
| 8,584,298 | B2 * | 11/2013 | Viscomi | A61C 19/002 15/104.92 |
| 2010/0252464 | A1 | 10/2010 | Belitz | |

FOREIGN PATENT DOCUMENTS

| | | | |
|---|---|---|---|
| DE | 9212051 | U1 | 2/1993 |
| WO | 2016/007097 | A1 | 1/2016 |

OTHER PUBLICATIONS

Office Action dated Sep. 16, 2016 issued in corresponding DE patent application No. 10 2016 100 954.7 (and partial English translation).

* cited by examiner

*Primary Examiner* — Rafael Ortiz

(74) *Attorney, Agent, or Firm* — Posz Law Group, PLC

(57) ABSTRACT

The invention is based on a musical instrument case, in particular for storage of a string instrument, with at least one housing, with at least one storage region, which is delimited by the housing, for storage of a musical instrument, and with at least one fixing unit, which is provided to fixate a musical instrument in the storage region at least substantially fixedly as regards a position. It is proposed that the at least one fixing unit comprises at least one structural element of low flexural strength, which is in a fixated state of a musical instrument provided to contact a body of the musical instrument.

15 Claims, 3 Drawing Sheets

MUSICAL INSTRUMENT CASE

CROSS REFERENCE TO RELATED APPLICATION

Figure 1:
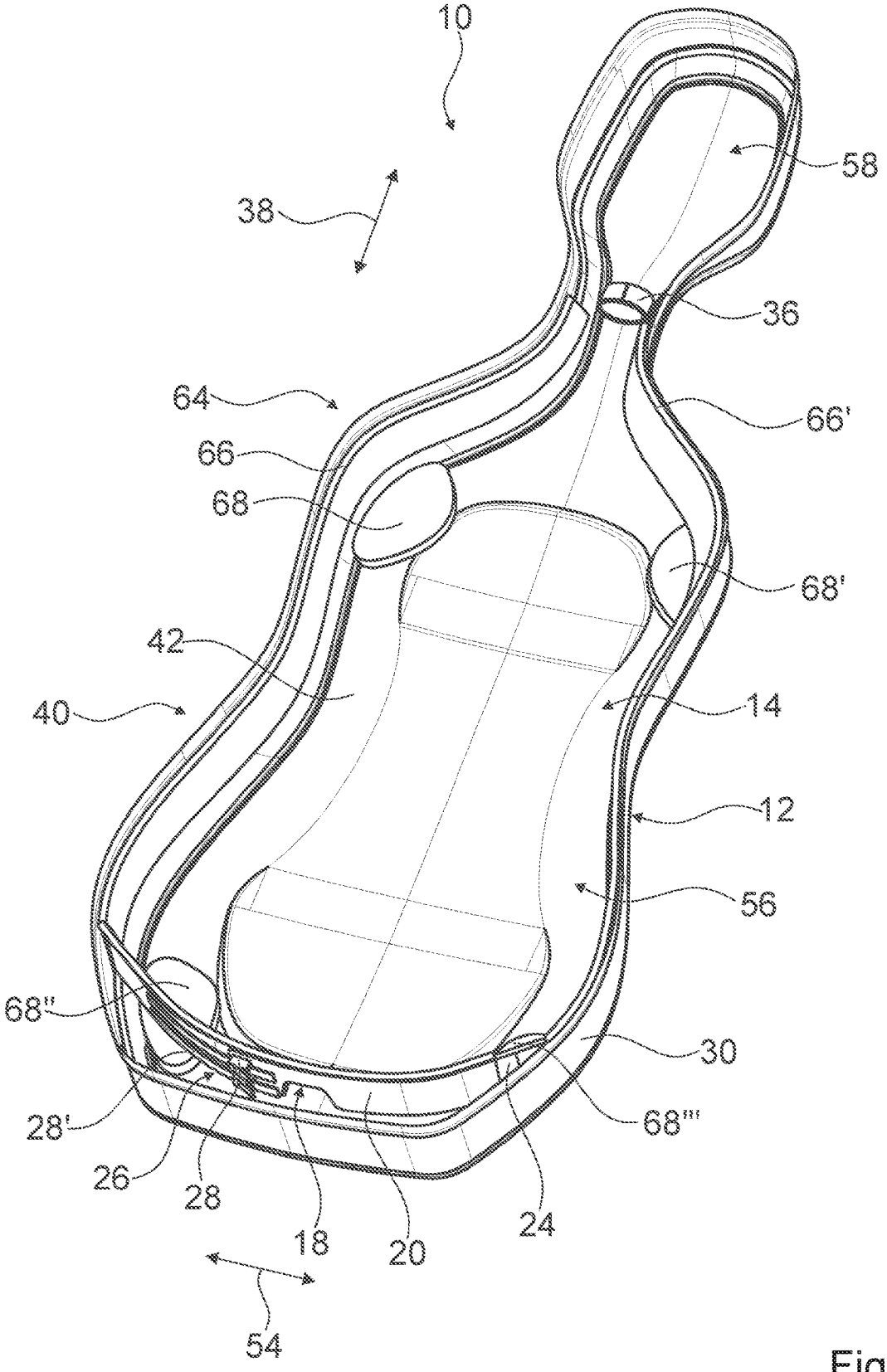

This application is based on and incorporates herein by reference German Patent Application No. 10 2016 100 954.7 filed on Jan. 20, 2016.

STATE OF THE ART

The invention relates to a musical instrument case, in particular for storage of a string instrument.

In particular with string instruments and/or bow instruments there are no obligatory size norms for measurements and/or tolerances. It is hence not easy to manufacture fitting cases for string instruments. The cases should further have the additional function of decoupling the musical instrument from vibrations and shocks which the housing of the musical instrument case is subject to.

Therefore a musical instrument case with at least one housing, with at least one storage region, which is delimited by the housing, for storage of a musical instrument, and with at least one fixing unit, which is provided to fixate a musical instrument in the storage region at least substantially fixedly as regards position, has already been proposed. Herein a fixation is effected by a flexible cushioning, with which an inner lining can be adapted. For this purpose, up to now foam elements are fixated in a case, which hold the musical instrument in a certain position and cushion the instrument merely by the dampening properties of the foam. This leads, however, to difficulties for a user when putting the instrument into the case and/or removing the instrument from the case. Such a musical instrument case thus either has too much tolerance for easily loading and/or unloading the case, or the instrument is fixated so firmly that many shocks are directly transmitted, removal of the instrument is additionally encumbered and too much pressure is exerted on the instrument. As an alternative, an inner lining may be individually adapted to the instrument that is to be stored.

The objective of the invention is in particular to provide a generic device with improved characteristics regarding a user comfort as well as regarding safety of the musical instrument. The objective is achieved according to the invention by the features of patent claim 1, while advantageous implementations and further developments of the invention may become apparent from the subclaims.

ADVANTAGES OF THE INVENTION

The invention is based on a musical instrument case, in particular for storage of a string instrument, with at least one housing, with at least one storage region limited by the housing for storage of a musical instrument, and with at least one fixing unit, which is provided to fixate a musical instrument in the storage region at least substantially fixedly as regards position.

It is proposed that the at least one fixing unit comprises at least one structural element of low flexural strength, which is in a fixated state of the musical instrument provided to contact a body of the instrument. Preferably the at least one structural element of low flexural strength is provided to contact a rib of a body of the musical instrument in a fixated state of the instrument. Preferentially the at least one structural element of low flexural strength is in particular provided to fixate the musical instrument in parallel to a main extension direction of the musical instrument case and/or of the musical instrument.

Particularly preferably the at least one structural element of low flexural strength is in particular provided for a dampening fixation of the musical instrument. The musical instrument is, at least in a stand-up state of the musical instrument case, held by the structural element of low flexural strength in particular at least partially oscillating. Preferentially the musical instrument case is implemented as a cello case. A "housing" is to be understood, in this context, in particular as a protective exterior sleeve of the musical instrument case. Preferably it is to be understood in particular as a unit forming a hard exterior sleeve of the musical instrument case. Furthermore, a "storage region" is to be understood, in this context, in particular as a region that serves to receive objects, in particular a musical instrument. Preferably it is to be understood, in particular, as a storage space for a musical instrument. Preferentially the region is at least approximately entirely surrounded by material units and/or elements of the musical instrument case, in particular by the housing, in at least one plane, preferably a plane extending through a geometrical center of the storage region. Especially preferentially, starting from a geometrical center of the storage region, the storage region is delimited by material units and/or elements of the musical instrument case, in particular by the housing, in at least four, preferably in at least five spatial directions. A "fixing unit" is to be understood, in this context, in particular as a unit that is provided to fasten a musical instrument in the housing of the musical instrument case at least substantially fixedly as regards a position with respect to the housing. It is preferably to be understood in particular as a unit that is provided to fixate the musical instrument in the housing in at least one extension direction in a form-fit and/or force-fit fashion. By "connected in a form-fit and/or force-fit fashion" is herein to be understood in particular a releasable connection, wherein a holding force is transferred between two structural elements preferably by way of the structural elements engaging with each other geometrically and/or by a friction force being transferred between the structural elements. Furthermore, in this context, "at least substantially fixedly as regards position" is to mean in particular that a maximum range of movement of a geometrical center of the musical instrument with respect to the musical instrument case is maximally 10 cm, preferably maximally 5 cm, preferentially no more than 2 cm and especially preferentially no more than 1 cm.

A "structural element of low flexural strength" is to be understood, in this context, in particular as a structural element, preferably an elongate structural element, which has low flexural strength at least in a direction perpendicular to a main extension direction. Preferably it is to be understood in particular as a structural component having no dimensional stability. Particularly preferably it is to be understood in particular as a structural element exerting in its extended state, in case of a pressure force acting in parallel to a main extension direction, a counterforce that is smaller than a weight force of the structural element. The counterforce is preferentially no more than 70%, preferably maximally 50% and particularly preferably no more than 30% of a weight force. A variety of structural elements of low flexural strength is conceivable, which are deemed expedient by a person skilled in the art, in particular, however, the structural element of low flexural strength is implemented at least partially or entirely by a tape and/or a rope. In this an "elongate structural element" is to be understood, in particular, as a structural element having a transverse extension that is by multiples smaller than a longitudinal extension along a middle fiber. A transverse extension is preferentially less than 20 cm, preferably less than 15 cm and particularly preferably less than 10 cm. Herein "by multiples smaller" is to mean, in particular, smaller by at least three-fold, preferably at least 5-fold and especially preferentially at least 10-fold. Preferably the structural element of low flexural strength is fixation-free at least over a substantial distance. Preferentially the structural element of low flexural strength does not have a direct fixation and/or connection to a further structural element of the musical instrument case at least over a substantial distance. Especially preferentially the structural element of low flexural strength is freely suspended at least over a substantial distance. "Provided" is to mean, in particular, specifically designed and/or equipped. By an object being provided for a certain function is to be understood, in particular, that the object implements and/or carries out said certain function in at least one application state and/or operating state.

The implementation of the musical instrument case according to the invention in particular allows storing the musical instrument reliably and safely. In particular, it allows an advantageous suspended storage of the instrument. In particular, due to the structural element of low flexural strength an optimum adaption of the musical instrument case to a shape of the musical instrument is achievable. As in particular cello cases, i.e. musical instrument cases for celli, are loaded and transported standing up, a "floating" support of an instrument is advantageous.

It is further proposed that the at least one structural element of low flexural strength of the fixation unit is implemented by a tape. The tape is preferably embodied as a belt strap.

Preferentially the tape is implemented padded at least in a partial region. Especially preferentially the tape is padded completely. A "tape" is to be understood, in this context, in particular as a tape-shaped structural element of low flexural strength. Preferably it is to be understood, in particular, as a structural element of low flexural strength which, if viewed in a sectional plane perpendicular to a main extension direction, has a width that is substantially larger than a height of the structural element of low flexural strength. In this, "substantially larger" is to mean in particular that a value of the width is at least two-fold, preferably no less than four-fold and particularly preferably at least six-fold larger than a value of the height. A "main extension direction" of a structural element is to mean in particular a direction extending in parallel to a greatest lateral edge of a smallest geometrical rectangular cuboid that just still completely encompasses the structural element, in the case of a structural element of low flexural strength in a maximally extended state. In this way in particular particularly reliable and safe storage of the musical instrument is achievable. Furthermore this allows the musical instrument being contacted by the structural element of low flexural strength over a large area. This advantageously allows avoiding a tilting of the instrument, in particular when contacting a rib of the body of the instrument.

Furthermore it is proposed that the at least one structural element of low flexural strength of the fixing unit comprises at least one resilient partial region. Preferably the resilient partial region is in particular at least partially made of a resilient material, in particular a non-destructively extendable material. By a "resilient partial region" is to be understood, in this context, in particular a macroscopic partial region having at least one extension that is in a usual operating state resiliently modifiable by at least 10%, in particular at least 20%, preferably at least 30% and particularly preferably at least 50%, and that in particular generates a counterforce acting counter to a change of the extension, which in particular depends on a change of the extension and is preferably proportional to the change. An "extension" of an element is to be understood in particular as a maximum distance of two points of a perpendicular projection of the element onto a plane. A "macroscopic element" is to be understood in particular as an element with an extension of at least 1 mm, in particular at least 5 mm and preferably no less than 10 mm. A "resilient material" is to be understood, in this context, in particular as a material that is repeatedly deformable, in particular at least extendable, without the material being mechanically damaged or destroyed and that in particular following a deformation autonomously seeks to regain an original form. Thus in particular especially reliable and secure storage of a musical instrument is achievable. Due to the resilient partial region of the structural element of low flexural strength in particular a good filling potential, i.e. good removal and/or loading characteristics, can be achieved. Moreover an advantageous decoupling of the fixing unit from the housing of the musical instrument case is achievable. As during a stand-up arrangement of the musical instrument case the instrument, in particular the rib, is quasi suspended in the structural element of low flexural strength, shocks can be advantageously absorbed as if by a leaf spring.

It is also proposed that the at least one resilient partial region of the at least one structural element of low flexural strength is arranged in a peripheral region of the structural element of low flexural strength. The peripheral region is herein to be understood, in particular, to be viewed transversely to a main extension direction of the structural element of low flexural strength. When viewed along the main extension direction of the structural element of low flexural strength, the resilient partial region is arranged in particular in a start region and/or end region of the structural element of low flexural strength. The resilient partial region is in particular arranged in a proximity of a connection region between the structural element of low flexural strength and the housing of the musical instrument case. Due to this in particular an advantageous arrangement of the resilient partial region is achievable. In this region, in particular a friction between the instrument and the resilient partial region can at least be kept at a low level and can preferentially be avoided.

It is further proposed that the at least one fixing unit comprises at least one adjusting unit, by means of which an effective length of the structural element of low flexural strength can be changed. Preferably the adjusting unit is provided for a toolless adjustment of an effective length of the structural element of low flexural strength. An "adjusting unit" is to be understood, in this context, in particular as a unit by means of which an effective length of the structural element of low flexural strength is implemented to be adjustable, in particular between at least two fastening points. Preferably it is to be understood in particular as a unit by means of which an extension of the structural element of low flexural strength, which extension is effectively used for fixation, is variably adjustable at least in a range of values. Especially preferentially it is to be understood in particular as a unit in which at least an effective length of the structural element of low flexural strength between at least two fastening points is variably adjustable at least in a range of values. Moreover, in this context, an "effective length" is to mean in particular an effectively used length. Preferably it is to be understood in particular as an extension of the structural element of low flexural strength between two fastening points. Preferentially it is to be understood in particular as a length of a partial region of the structural element of low flexural strength that is charged with a load during fixation. As a result of this in particular an advantageously variable adjustment of the fixing unit is achievable. Preferably this allows advantageously adapting the musical instrument case to different sizes of musical instruments. In particular, in this way an optimum adaption of the structural element of low flexural strength to the shape and/or size of the instrument is achievable, in particular in case of constant pressure. This allows a secure hold of the musical instrument in the musical instrument case. Furthermore a quick adjustment of the fixing unit for different musical instruments is achievable, without further structural elements being required.

Furthermore it is proposed that the at least one adjusting unit of the fixing unit comprises at least one ratchet locking. By a "ratchet locking" is to be understood, in this context, in particular an adjustable locking. Preferably it is to be understood in particular as a locking as is known, for example, from snowboard soft bindings. It is preferentially to be understood as a locking comprising at least two fastening points, an effective distance of which is implemented in such a way that it can be changed via a latch band. Preferably it is to be understood in particular as a locking comprising at least one latch band and at least one ratchet element. Preferably the latch band is connected to a first fastening point and the ratchet element is connected to a second fastening point. A "latch band" is herein to be understood in particular as a fastening strap comprising a plurality of latch elements at least on one side, in particular on a side defined by the width and the length of the fastening strap. Preferably the latch elements are implemented by latch ramps that are oriented perpendicularly to the length, in particular arranged successively in parallel to the length. Preferentially, in a wound off, hypothetically flatly extended state of the latch band, the latch ramps have the same orientation. Particularly preferably the latch elements take up a substantial portion, in particular at least 50%, preferably at least 60% and especially preferentially at least 80% of the latch band. The ratchet element is in particular provided to latch with different latch ramps, wherein an effective distance of the fastening points is changed depending on the rast ramp. This allows in particular providing an advantageously comfortable adjusting unit. A high level of operator comfort is achievable. Moreover this allows providing an advantageously reliable adjusting unit.

It is further proposed that the at least one structural element of low flexural strength of the fixing unit extends between two lateral walls of the housing that are situated opposite each other. Preferably the structural element of low flexural strength is fixedly connected to at least one of the lateral walls of the housing. Preferentially the structural element of low flexural strength is connected to the opposite lateral wall via the adjusting unit. Preferaby the at least one structural element of low flexural strength of the fixing unit extends between two opposite partial regions of the lateral walls of the housing, which extend at least substantially in parallel to a main extension direction of the musical instrument case. By a "lateral wall" of the housing is to be understood, in this context, in particular a region of the housing that extends substantially in parallel to a rib of the body of the musical instrument, in particular in a state when the instrument is stored. It is preferably to be understood in particular as a region facing the rib of the body of the instrument. Preferentially it is to be understood in particular as a region extending substantially perpendicularly to a rear side of the housing. In this way in particular an advantageous arrangement of the fixing unit, in particular of the structural element of low flexural strength, is achievable. Furthermore, in particular an advantageously "floating" support of the musical instrument is thus achievable.

It is moreover proposed that the at least one structural element of low flexural strength of the fixing unit is provided to contact in a fixated state of the musical instrument a body of the instrument on a side facing away from a fingerboard of the instrument. Preferably the at least one structural element of low flexural strength is provided to contact in a fixated state of a musical instrument a rib of the instrument on a side facing away from a fingerboard and/or a neck of the instrument. In this way in particular a reliable and safe storage of a musical instrument is achievable. In particular an advantageously suspended support of a musical instrument is thus achievable.

Furthermore it is proposed that the at least one fixing unit is provided to press a stored musical instrument against the housing in a shoulder region of the body. By a "shoulder region" of a body of a musical instrument is to be understood, in this context, in particular a region of a rib of the body which extends in a proximity region of the fingerboard of the instrument. Preferentially it is to be understood as a region of the rib that extends on both sides of the fingerboard. Herein by "against the housing" is to be understood both that the musical instrument is pressed against the housing in a shoulder region in such a way that it directly contacts the housing and that the musical instrument is pressed against the housing in a shoulder region indirectly, i.e. if there is, for example, a cushioning between the housing and the shoulder region. Preferably a cushioning is arranged in a region of the housing that faces the shoulder region. Particularly preferably the structural element of low flexural strength of the fixing unit for fixing the instrument is provided to mould to the rib, to press the body of the instrument upwards in parallel to a main extension direction of the musical instrument case and to press against a cushioning of the housing in a neck transition zone or in a shoulder region. In this way in particular a reliable and safe storage of a musical instrument is achievable. In particular an advantageously suspended storage of a musical instrument is thus achievable.

It is also proposed that the musical instrument case comprises a second fixing unit, which is provided to fixate a stored musical instrument perpendicular to a main extension direction of the musical instrument. Preferentially the second fixing unit is provided to fixate a stored musical instrument perpendicularly to a main extension direction of the musical instrument case. Preferably the second fixing unit is provided to fixate a neck of the musical instrument. Preferentially the second fixing unit fixates the musical instrument in particular in a direction substantially perpendicular to a fixating direction of the fixing unit. This allows in particular an especially reliable and safe storage of a musical instrument.

Moreover it is proposed that the at least one second fixing unit is provided to fixate a fingerboard of a stored musical instrument. Preferably the second fixing unit comprises at least one tape, by means of which a fingerboard of the musical instrument can be fixated. The tape can be embodied in particular, for example, by a hook-and-loop fastener. In this way in particular an especially reliable and safe storage of a musical instrument is achievable.

The musical instrument case according to the invention is herein not to be limited to the application and implementation form described above. For the purpose of implementing a functionality herein described, the musical instrument case according to the invention may in particular comprise a number of respective elements, structural components and units that differs from a number herein mentioned.

DRAWINGS

Further advantages will become apparent from the following description of the drawings. In the drawings one exemplary embodiment of the invention is shown. The drawing, the description and the claims contain a plurality of features in combination. The person skilled in the art will purposefully consider the features separately and will find further expedient combinations.

Figure 2:
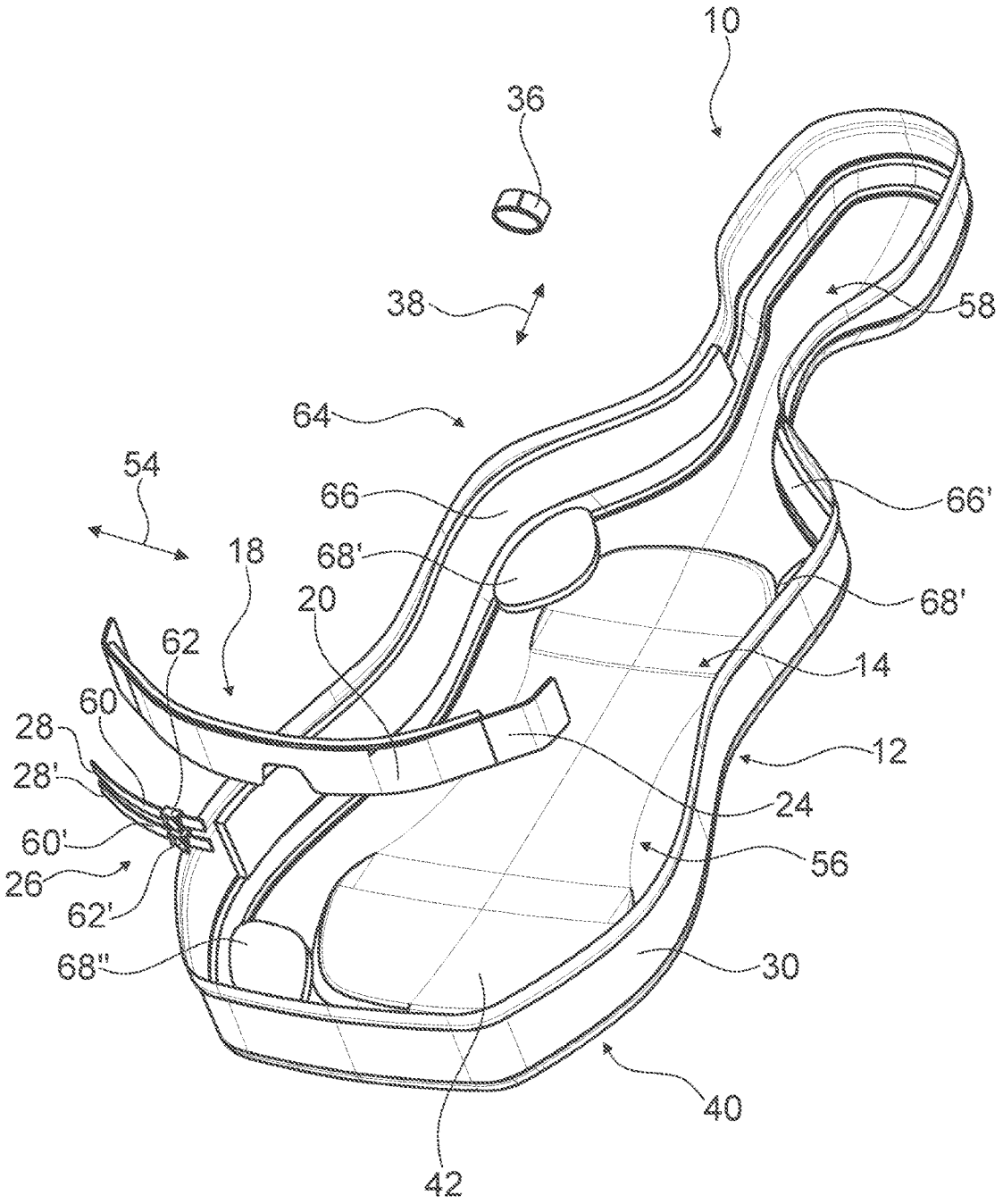
Figure 3:
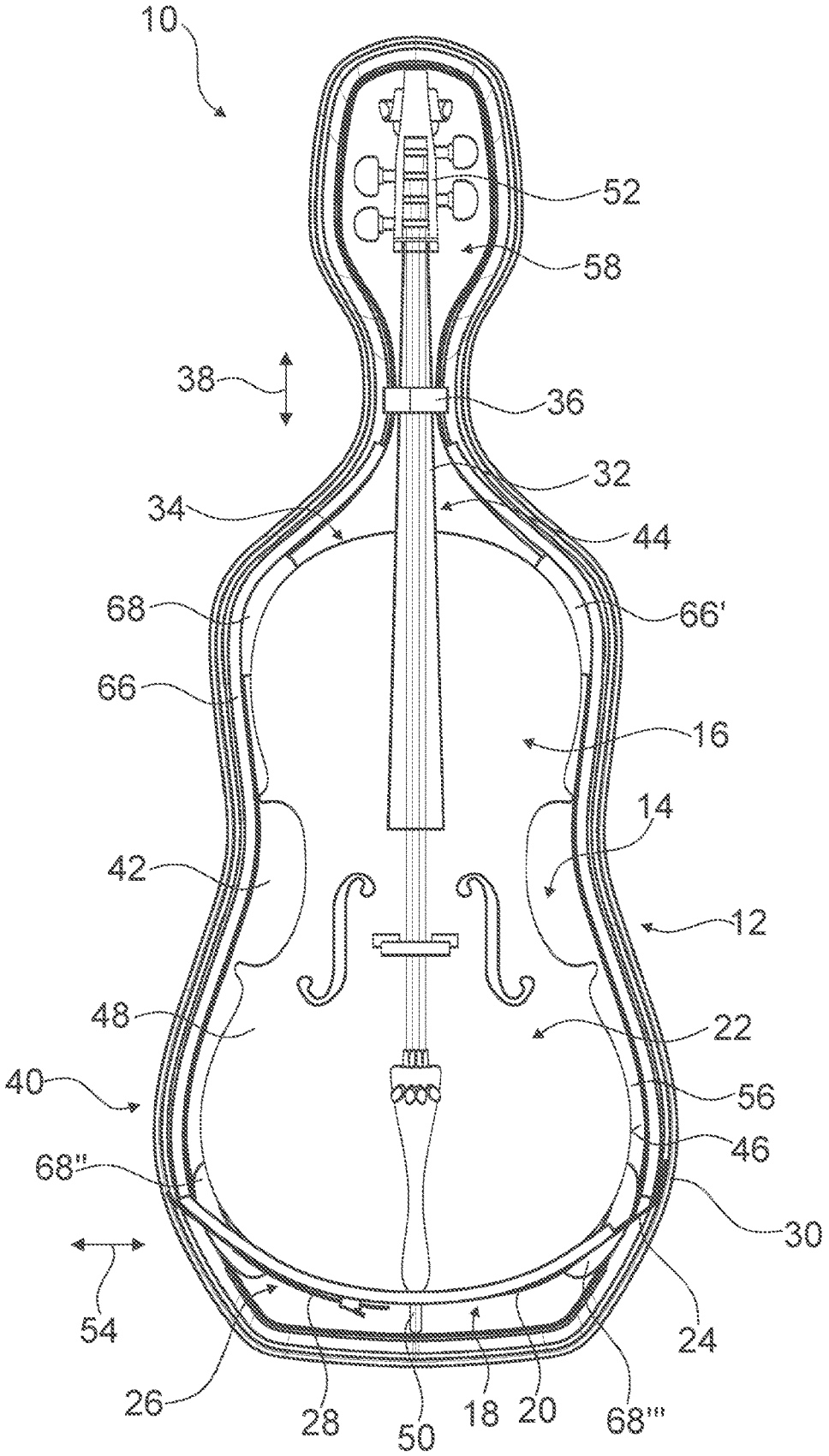

It is shown in:

FIG. 1 a musical instrument case according to the invention, with a housing, with a storage region and with a fixing unit, in a schematic view, FIG. 2 the musical instrument case according to the invention, with the housing, with the storage region and with the fixing unit, in a schematic exploded view, and FIG. 3 the musical instrument case according to the invention with a musical instrument stored therein.

DESCRIPTION OF THE EXEMPLARY EMBODIMENT

FIG. 1 shows a musical instrument case 10. The musical instrument case 10 is embodied by a cello case. The musical instrument case is embodied by a cello box. Principally, however, a different implementation of the musical instrument case 10 deemed expedient by a person skilled in the art would also be conceivable, e.g. as a guitar case, as a violin case, a viola case or a double bass case. The musical instrument case 10 is provided to store a string instrument. The musical instrument case 10 further comprises a housing 12. The housing 12 is implemented by a shell housing. The housing 12 comprises two housing shells. One of the housing shells is embodied by a lid that is not shown in detail. The further housing shell forms a base body 40 of the housing 12. The base body 40 is provided to directly store a musical instrument 16, the lid (not shown in detail) being provided for closure of the base body 40. The lid can be connected to the base body 40 of the housing 12 via quick-release clamps in a manner that is not visible in detail. Furthermore the musical instrument case 10 comprises a storage region 14 that is delimited by the housing 12. The storage region 14 is provided for storage of a musical instrument 16. The musical instrument 16 is embodied by a cello. Principally, however, a different embodiment of the musical instrument 16, deemed expedient by a person skilled in the art, would also be conceivable, e.g. as a guitar, a violin, a viola or a double bass. The storage region 14 is delimited by the base body 40 and the lid (not visible in detail) of the housing 12. In a closed state of the housing 12 the storage region 14 is substantially closed off. A shape of the base body 40 is adapted to a general shape of the musical instrument 16. An outer contour of the base body 40 roughly corresponds to a shape of the musical instrument 16. The base body 40 of the housing 12 comprises a rear side 42. The rear side 42 is substantially planar. The rear side 42 has a bump in a region of the base body 40 that serves to receive a neck 44 of the musical instrument 16. A shape of the rear side 42 roughly corresponds to a two-dimensional contour of the musical instrument 16. A back of a body 22 of the musical instrument 16 faces the rear side 42 in a state when the musical instrument 16 is stored. In a peripheral region of the rear side 42 a circumferential lateral wall 30 of the base body 40 abuts on the rear side 42. The lateral wall 30 extends substantially perpendicular to the rear side 42. A rib 46 of the body 22 of the musical instrument 16 faces the lateral wall 30 in a state when the musical instrument 16 is stored. The rib 46 extends substantially in parallel to the lateral wall 30. The musical instrument 16 is in a state when stored encompassed by the base body 40. The musical instrument 16 is in a state when it is stored completely encompassed by the base body 40 in a plane parallel to the back of the body 22 of the musical instrument 16. A side of the musical instrument 16, which faces a top 48 of the body 22 of the musical instrument 16, is in a state when it is stored covered by the lid (not visible in detail) of the housing 12. The body 22 forms a resonant body, i.e. the sound box, of the musical instrument 16. The rib 46 designates those structural components of the body 22 of the musical instrument 16 which form its lateral wall, respectively lateral walls.

The musical instrument case 10 further comprises a fixing unit 18. The fixing unit 18 is implemented as a first fixing unit. The fixing unit 18 is provided to fixate a musical instrument 16 in the storage region 14 substantially fixedly as regards a position. The fixing unit 18 is provided to fixate the body 22 of the musical instrument 16 in the storage region 14 substantially fixedly as regards a position. The fixing unit 18 is provided for a fixation of the musical instrument 16 in parallel to a main extension direction 38 of the musical instrument 16. The main extension direction 38 of the musical instrument 16 substantially corresponds to a main extension direction of the musical instrument case 10. The main extension direction 38 of the musical instrument 16 extends substantially in parallel to an imaginary straight line running between an end pin 50 and a peg box 52.

The fixing unit 18 comprises a structural element 20 of low flexural strength. The structural element 20 of low flexural strength is in a fixated state of the musical instrument 16 provided to contact the body 22 of the musical instrument 16. In a fixated state of the musical instrument 16 the structural element 20 of low flexural strength is provided to contact the rib 46 of the body 22 of the musical instrument 16. The structural element 20 of low flexural strength is provided for a dampening fixation of the musical instrument 16. The structural element 20 of low flexural strength of the fixing unit 18 is embodied by a tape. The structural element 20 of low flexural strength of the fixing unit 18 is embodied by a belt strap. Furthermore the structural element 20 of low flexural strength is embodied in such a way that it is padded. For this purpose he structural element 20 of low flexural strength is partially made of a foam material. The structural element 20 of low flexural strength of the fixing unit 18 extends between two lateral walls 30 of the housing 12 that are situated opposite each other. The structural element 20 of low flexural strength of the fixing unit 18 is fixedly connected to the lateral wall 30 with two opposite ends at two opposite partial regions of the lateral wall 30. Principally it would, however, also be conceivable that the structural element 20 of low flexural strength is fixedly connected to the lateral wall 30 only with one end. The structural element 20 of low flexural strength of the fixing unit 18 extends between two opposite partial regions of the lateral wall 30 of the housing 12, which extend substantially in parallel to the main extension direction of the musical instrument case 10. The structural element 20 of low flexural strength extends substantially perpendicular to the main extension direction of the musical instrument case 10 and in parallel to a main extension plane of the rear side 42 of the base body 40 of the housing 12. A main extension direction 54 of the structural element 20 of low flexural strength extends substantially perpendicular to the main extension direction of the musical instrument case 10 and in parallel to a main extension plane of the rear side 42 of the housing 12. By a "main extension plane" of a structural unit is to be understood in particular a plane that is parallel to a greatest lateral surface of a smallest imaginary rectangular cuboid that just still entirely encompasses the structural unit and which in particular extends through the center point of the rectangular cuboid. The structural element 20 of low flexural strength of the fixing unit 18 is arranged in a body storage region 56 of the storage region 14, which serves to receive the body 22 of the musical instrument 16. The structural element 20 of low flexural strength is arranged on a side of the body storage region 56 that faces away from a neck storage region 58 of the storage region 14, which serves to receive the neck 44 and the peg box 52 of the musical instrument 16. The neck storage region 58 of the storage region 14 directly abuts on the body storage region 56 of the storage region 14. The neck storage region 58 is connected to the body storage region 56.

The structural element 20 of low flexural strength of the fixing unit 18 is provided, in a fixated state of the musical instrument 16, to contact the body 22 of the musical instrument 16 on a side that faces away from a fingerboard 32 of the musical instrument 16. The structural element 20 of low flexural strength of the fixing unit 18 is provided, in a fixated state of the musical instrument 16, to contact the rib 46 of the body 22 of the musical instrument 16 on a side that faces away from a fingerboard 32 of the musical instrument 16.

The structural element 20 of low flexural strength of the fixing unit 18 comprises a resilient partial region 24. The resilient partial region 24 is partially made of a resilient material. The resilient partial region 24 is embodied by a rubber band, in particular an elasticated rubber band. Principally, however, a different implementation of the resilient partial region 24 that is deemed expedient by a person skilled in the art is also conceivable. The resilient partial region 24 of the structural element 20 of low flexural strength is arranged in a peripheral region of the structural element 20 of low flexural strength. The peripheral region is herein to be understood to be viewed transversely to the main extension direction 54 of the structural element 20 of low flexural strength. If viewed along the main extension direction 54 of the structural element 20 of low flexural strength, the resilient partial region 24 is arranged in a start region respectively in an end region of the structural element 20 of low flexural strength. The resilient partial region 24 is arranged in a proximity of a connection zone between the structural element 20 of low flexural strength and the housing 12 of the musical instrument case 10. The resilient partial region 24 of the structural element 20 of low flexural strength directly abuts on the housing 12. The structural element 20 of low flexural strength is connected to the housing 12 at one end via the resilient partial region 24. Principally, however, a different arrangement of the resilient partial region 24 that is deemed expedient by a person skilled in the art would also be conceivable.

The fixing unit 18 further comprises an adjusting unit 26. By means of the adjusting unit 26 an effective length of the structural element 20 of low flexural strength can be changed. The adjusting unit 26 is provided for a toolless adjustment of an effective length of the structural element 20 of low flexural strength. The adjusting unit 26 is connected to the structural element 20 of low flexural strength at two ends in spaced-apart points. By means of the adjusting unit 26 a distance between the two ends can be changed. Due to this, a distance between the two spaced-apart points of the structural element 20 of low flexural strength is also changed, as a result of which an effective length of the structural element 20 of low flexural strength is changed. Principally, however, it would be also conceivable that the adjusting unit 26 is arranged in a connection zone between the housing 12 and the structural element 20 of low flexural strength. Herein it would be conceivable in particular that the structural element 20 of low flexural strength is connected to the housing 12 on a side opposite the resilient partial region 24 via the adjusting unit 26. For this purpose one end of the adjusting unit 26 could be connected to the housing 12 while the other end is connected to the structural element 20 of low flexural strength.

The adjusting unit 26 of the fixing unit 18 comprises at least one ratchet locking 28, 28'. In an exemplary way, the adjusting unit 26 comprises two ratchet lockings 28, 28'. Principally, however, it would also be conceivable that the adjusting unit 26 comprises only one ratchet locking 28. The two ratchet lockings 28, 28' each comprise a latch band 60, 60' and a ratchet element 62, 62'. The latch bands 60, 60' each comprise a plurality of latch ramps, which are arranged one behind the other. The ratchet elements 62, 62' are respectively provided to latch with different latch ramps, wherein an effective distance of the fastening points is changed depending on the latch ramp. A latching can be released manually by a user. The latch bands 60, 60' each comprise a first fastening point of the adjusting unit 26, while the ratchet elements 62, 62' each comprise a second, spaced-apart fastening point of the adjusting unit 26. Ratchet lockings 28, 28' of this type are known, for example, from snowboard soft bindings.

The fixing unit 18 is provided to press a stored musical instrument 16 against the housing 12 in a shoulder region 34 of the body 22. For this purpose the musical instrument 16 is contacted by the structural element 20 of low flexural strength of the fixing unit 18 on a side of the rib 46 of the body 22 of the musical instrument 16 that faces away from a fingerboard 32 of the musical instrument 16. By way of adjusting the adjusting unit 26, the musical instrument 16 can be lifted and can be pressed against the housing 12 in the shoulder region 34 of the body 22. Due to the resilient partial region 24 of the structural element 20 of low flexural strength, furthermore a good fillability, i.e. good removal and loading characteristics, of the musical instrument case 10 is achievable when an adjustment of the adjusting unit 26 has already taken place. Further an advantageous decoupling of the fixing unit 18 from the housing 12 of the musical instrument case 10 can be achieved. Moreover, as the rib 46 of the musical instrument 16 is quasi pending in the structural element 20 of low flexural strength during a stand-up storage of the musical instrument case 10, shocks can be advantageously absorbed as if by a leaf spring. The base body 40 of the housing 12 further comprises a cushioning 64 on an inner side that faces the musical instrument 16. The cushioning 64 comprises two cushioning strips 66, 66', which extend along the lateral wall 30 on both sides of the body storage region 56 of the storage region 14. The cushioning strips 66, 66' are, for example, also arranged in a region of the housing 12 that faces the shoulder region 34. The cushioning strips 66, 66' are substantially made of a foam material. Principally, however, a different material that is deemed expedient by a person skilled in the art would also be conceivable. The cushioning 64 further comprises four cushioning pads 68, 68', 68'', 68''', which are arranged on an inner side of the rear side 42 of the base body 40 in the body storage region 56 of the storage region 14. The cushioning pads 68, 68', 68", 68'" are provided to abut on the back of the body 22 of the musical instrument 16. The cushioning pads 68, 68', 68", 68'" are substantially made of a foam material. Principally, however, a different material that is deemed expedient by a person skilled in the art would also be conceivable.

The musical instrument case 10 further comprises a second fixing unit 36. The second fixing unit 36 is provided to fixate the stored musical instrument 16 perpendicularly to the main extension direction 38 of the musical instrument 16. The second fixing unit 36 is provided to fixate the stored musical instrument 16 in a direction that is substantially perpendicular to a fixation direction of the fixing unit 18. The second fixing unit 36 is provided to fixate the fingerboard 32 of the stored musical instrument 16. The second fixing unit 36 is provided to fixate the neck 44 of the stored musical instrument 16. The second fixing unit 36 is arranged in the neck storage region 58 of the storage region 14. The second fixing unit 36 is fixedly connected to the housing 12. The second fixing unit 36 is provided to clasp around a neck 44 of the musical instrument 16. For this purpose the second fixing unit 36 comprises a tape by means of which the neck 44 of the musical instrument 16 can be fixated. The tape is embodied, as an example, by a hook-and-loop fastener tape. Principally, however, a different implementation of the second fixing unit 36, which is deemed expedient by a person skilled in the art, would also be conceivable.

The invention claimed is:

1. A musical instrument case, for storage of a string instrument, with at least one housing, with at least one storage region, which is delimited by the housing, for storage of the string instrument, and with at least one fixing unit, which is provided to fixate the string instrument in the storage region at least substantially fixedly as regards a position, wherein the at least one fixing unit comprises at least one structural element of low flexural strength, which is in a fixated state of the string instrument provided to contact a body of the string instrument, the at least one fixing unit is provided to press a stored string instrument against a shoulder region of the housing, and wherein the at least one structural element of low flexural strength of the fixing unit is implemented by a tape.

2. The musical instrument according to claim 1, wherein the at least one structural element of low flexural strength of the fixing unit comprises at least one resilient partial region.

3. The musical instrument case according to claim 2, wherein the at least one resilient partial region of the at least one structural element of low flexural strength is arranged in a peripheral region of the structural element of low flexural strength.

4. The musical instrument case according to claim 1, wherein the at least one fixing unit comprises at least one adjusting unit, by means of which an effective length of the structural element of low flexural strength can be changed.

5. The musical instrument case according to claim 4, wherein the at least one adjusting unit of the fixing unit comprises at least one ratchet locking.

6. The musical instrument case according to claim 1, wherein the at least one structural element of low flexural strength of the fixing unit extends between two lateral walls of the housing that are situated opposite each other.

7. The musical instrument case according to claim 1, wherein the at least one structural element of low flexural strength of the fixing unit is arranged on a bottom side of the housing, facing away from a fingerboard receiving region of the housing.

8. The musical instrument case according to claim 1, comprising a second fixing unit, which is provided to fixate the stored string instrument perpendicular to a main extension direction of the string instrument.

9. The musical instrument case according to claim 8, wherein the at least one second fixing unit is arranged at a fingerboard receiving region of the housing for fixing a fingerboard of a stored musical instrument.

10. A fixing unit of a musical instrument case according to claim 1.

11. The musical instrument case according to claim 8, wherein the first fixing unit is provided to fixate the stored string instrument parallel to a main extension direction of the string instrument.

12. The musical instrument case according to claim 1, wherein the at least one structural element is located in a soundboard receiving region of the housing opposite a fingerboard receiving region of the housing.

13. The musical instrument case according to claim 12, wherein the at least one structural element is located only on one end of the soundboard receiving region of the housing opposite the fingerboard receiving region of the housing.

14. A musical instrument case, for storage of a string instrument, with at least one housing, with at least one storage region, which is delimited by the housing, for storage of the string instrument, and with at least one fixing unit, which is provided to fixate the string instrument in the storage region at least substantially fixedly as regards a position, wherein the at least one fixing unit comprises at least one structural element of low flexural strength, which is in a fixated state of the string instrument provided to contact a body of the string instrument, the at least one structural element is located in a soundboard receiving region of the housing opposite a fingerboard receiving region of the housing, the at least one structural element is configured to provide a pressing force in a direction toward the fingerboard receiving region, the at least one structural element is located only on one end of the soundboard receiving region of the housing opposite the fingerboard receiving region of the housing, and wherein the at least one structural element of low flexural strength of the fixing unit is implemented by a tape.

15. The musical instrument case according to claim 14, further comprising a second fixing unit configured to provide a restraining force in a direction perpendicular to a main extension direction of the housing.

* * * * *